US007157989B2

(12) United States Patent
Kim et al.

(10) Patent No.: US 7,157,989 B2
(45) Date of Patent: Jan. 2, 2007

(54) INLINE WAVEGUIDE PHASE SHIFTER WITH ELECTROMECHANICAL MEANS TO CHANGE THE PHYSICAL DIMENSION OF THE WAVEGUIDE

(75) Inventors: Seong-Hwoon Kim, Ocoee, FL (US); Michael E. Weinstein, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 484 days.

(21) Appl. No.: 10/091,398

(22) Filed: Mar. 7, 2002

(65) Prior Publication Data

US 2003/0169127 A1 Sep. 11, 2003

(51) Int. Cl.
*H01P 1/18* (2006.01)

(52) U.S. Cl. ..... 333/159

(58) Field of Classification Search ..... 333/159, 333/157

See application file for complete search history.

(56) References Cited

U.S. PATENT DOCUMENTS 2,775,741 A * 12/1956 Corbell ..... 333/159
4,575,697 A * 3/1986 Rao et al. ..... 333/159 X
4,768,001 A 8/1988 Chan-Son-Lint et al.
5,309,166 A 5/1994 Collier et al.
5,504,466 A 4/1996 Chan-Son-Lint et al.
5,757,319 A 5/1998 Loo et al.
6,016,122 A 1/2000 Malone et al.
6,020,853 A 2/2000 Richards et al.
6,154,176 A 11/2000 Fathy et al.
6,184,827 B1 2/2001 Dendy et al.
6,281,766 B1 * 8/2001 Malone et al. ..... 333/159

FOREIGN PATENT DOCUMENTS

GB 706716 * 4/1954 ..... 333/157
JP 72301 * 4/1985 ..... 333/159
SU 1485331 * 6/1989 ..... 333/159
SU 1571704 * 6/1990 ..... 333/159
SU 1762346 * 9/1992 ..... 333/157

* cited by examiner

*Primary Examiner*—Benny Lee
(74) *Attorney, Agent, or Firm*—Buchanan Ingersoll & Rooney

(57) ABSTRACT

An inline phase shifter including a waveguide having a waveguide path and one of a micro-electromechanical device and a piezoelectric device positioned sufficiently adjacent to the waveguide for changing physical dimensions of the waveguide path upon actuation of the one device.

26 Claims, 7 Drawing Sheets

INLINE WAVEGUIDE PHASE SHIFTER WITH ELECTROMECHANICAL MEANS TO CHANGE THE PHYSICAL DIMENSION OF THE WAVEGUIDE

BACKGROUND

1. Field of the Invention

The present invention relates to a phase shifter, and in particular, to an inline phase shifter.

2. Background Information

A first type of phase shifter is an electrically reactive structure in which electrical reactive properties are altered by applied voltages or by changing the relation between electrically reactive elements. U.S. Pat. No. 5,309,166 to Collier et al., hereby incorporated by reference, discloses a phase shifter in which electrical reactive properties are altered by applied voltages. U.S. Pat. No. 5,504,466 to Chan-Son-Lint et al., hereby incorporated by reference, discloses a phase shifter in which electrical reactive properties are altered by changing the relation between electrically reactive elements with a piezoelectric element.

A second type of phase shifter is a delay type phase shifter that uses a switch to switch between signal paths in combination with electrical reactive elements. U.S. Pat. No. 6,184,827 to Dendy et al., hereby incorporated by reference, discloses a phase shifter in which the signal path is altered by changing the length of the signal path with a MEMS switch to switch between lengths of transmission line.

The first and the second types of devices can phase shift a signal within a range of phases but inherently degrade the signal strength because of power losses due to electrical resistances.

A third type of phase shifter is a fixed waveguide having fixed dimensions in terms of the cross-sectional area of the waveguide path through the waveguide and the length of the waveguide. The fixed waveguide can phase shift a signal with minimal signal strength degradation. However, a fixed waveguide can only phase shift a signal to one predetermined phase based on the physical dimensions of the waveguide.

SUMMARY OF THE INVENTION

The present invention is directed to an inline phase shifter. Exemplary embodiments of the invention dynamically change the physical dimensions of a waveguide path with an electromechanical means to phase shift a signal to any phase within a range of phases. A signal can be phase shifted to a predetermined degree of phase shift within a range of phases by controlling the physical dimensions of the waveguide path.

Exemplary embodiments of the present invention include a waveguide having a waveguide path within the waveguide and at least one electromechanical means for changing a physical dimension of the waveguide path to phase shift a signal that travels along the waveguide path. The exemplary embodiments also include a method for phase shifting a signal that includes changing physical dimensions of a waveguide path by actuating an electromechanical device and inputting a signal along the waveguide path to output a phase shifted signal. Exemplary embodiments are also directed to an inline phase shifter that includes a waveguide having a waveguide path and a first plurality of electromechanical devices positioned serially along the waveguide path sufficiently adjacent to the waveguide path to change a physical dimension of the waveguide path upon actuation.

BRIEF DESCRIPTION OF THE DRAWINGS

The accompanying drawings, which are included to provide a further understanding of the invention and are incorporated in and constitute a part of this specification, illustrate embodiments of the invention that together with the description serve to explain the principles of the invention. In the drawings.

DETAILED DESCRIPTION OF THE PREFERRED EMBODIMENTS

Figure 1:
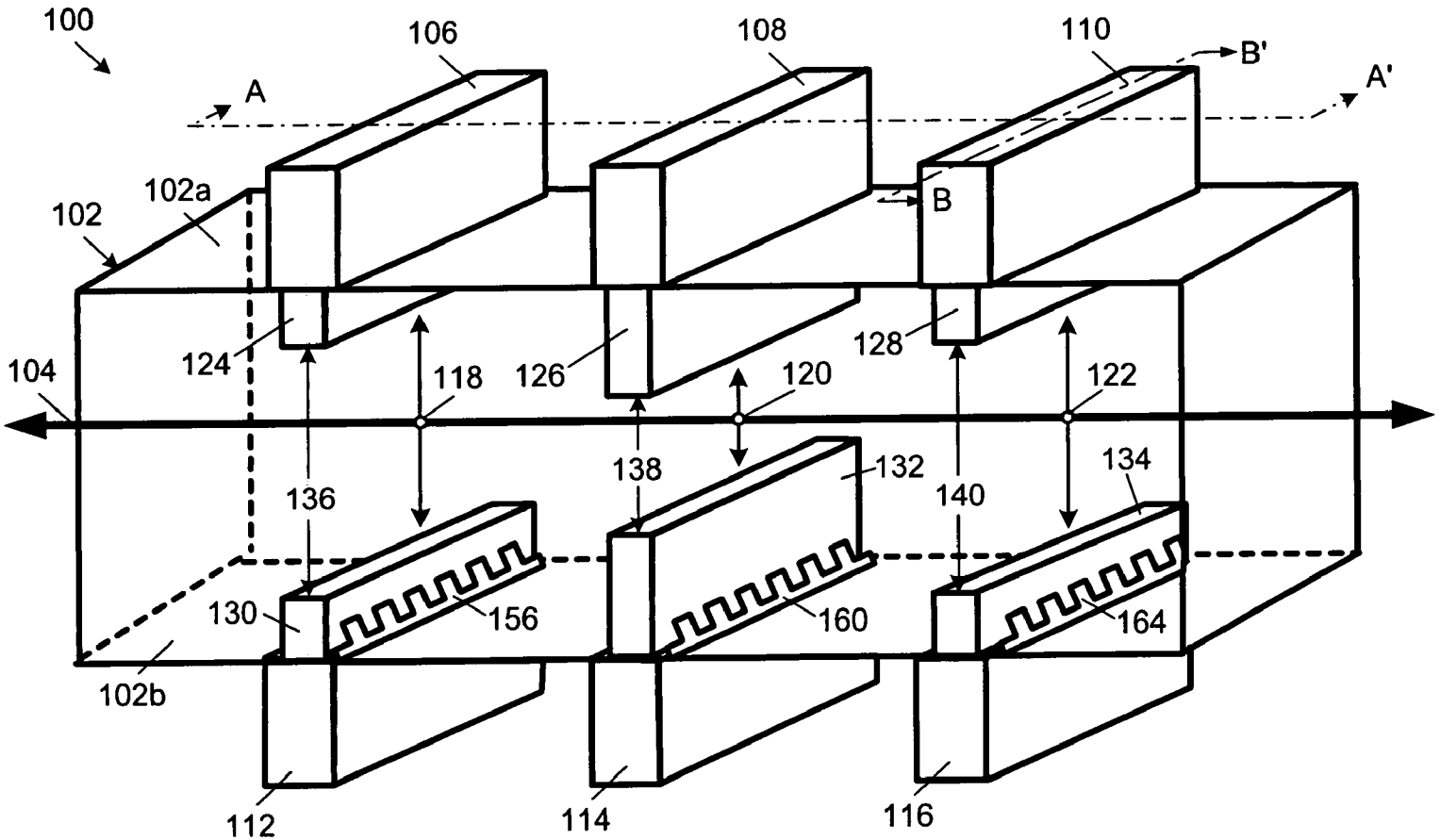
FIG. 1 is a perspective view of an exemplary embodiment using electromechanical devices.

FIG. 1 is an exemplary embodiment of a waveguide having a waveguide path within a waveguide, and an electromechanical means for changing a physical dimension of the waveguide path to phase shift a signal that travels along the waveguide path. In the exemplary embodiment of FIG. 1, a dynamic inline phase shifter 100 includes a waveguide 102 through which a signal can travel along a waveguide path 104. The waveguide 102 has a first (e.g., top) surface 102*a* and a second (e.g., bottom) surface 102*b* that are parallel to one another. Positioned adjacent to and along the top surface 102*a* are a first electromechanical means 106, a second electromechanical means 108, and a third electromechanical means 110. Positioned adjacent to and along the bottom surface 102*b* are a fourth electromechanical means 112, a fifth electromechanical means 114, and a sixth electromechanical means 116.

The first electromechanical means 106, second electromechanical means 108, and a third electromechanical means 110 can be a plurality of electromechanical devices positioned serially along the waveguide path sufficiently adjacent to the waveguide path to change a physical dimension of the waveguide path upon actuation of at least one of the plurality of electromechanical devices. As referenced herein, an electromechanical device is positioned sufficiently adjacent to the waveguide path when it can alter a physical dimension of the waveguide path by any detectable amount. In addition, the fourth electromechanical means 112, fifth electromechanical means 114, and sixth electromechanical means 116 can be another plurality of electromechanical means positioned serially along the waveguide path sufficiently adjacent to the waveguide path to change a physical dimension of the waveguide path upon actuation of at least one of the other plurality of electromechanical devices. Each of the electromechanical means 106, 108, 110, 112, 114, 116 is one of a piezoelectric device, micro-electromechanical device, electrostatic device, or another type of electromechanical device suitable for changing a physical dimension of the waveguide path.

As shown in the exemplary FIG. 1 embodiment, a plane containing the first electromechanical means 106 and fourth electromechanical means 112 is normal to the waveguide path 104 at point 118 and the planes containing the other sets of electromechanical means 108/114 and 110/116 are normal to the waveguide path 104 at points 120 and 122, respectively. As referenced herein, "normal" refers to being oriented relative to the path in a manner sufficient to impact the path upon actuation. Each of the electromechanical means 106, 108, 110, 112, 114, 116 respectively has a shutter 124, 126, 128, 130, 132, 134. The upper shutters 124, 126, 128 can descend toward the bottom surface 102*b* and the lower shutters 130, 132, 134 can ascend toward the top surface 102*a*. Between each of the shutters (e.g., 124 and 130) of a respective set of electromechanical means (e.g., 106 and 112) there is an opening (e.g., 136) normal to the waveguide path 104 between the shutters (e.g., 124 and 130). The height of the opening (e.g., 136) between respective shutters (e.g., 124 and 130) is dependent upon the amount of actuation that has taken place in their respective electromechanical means (e.g., 106 and 112).

Figure 2:
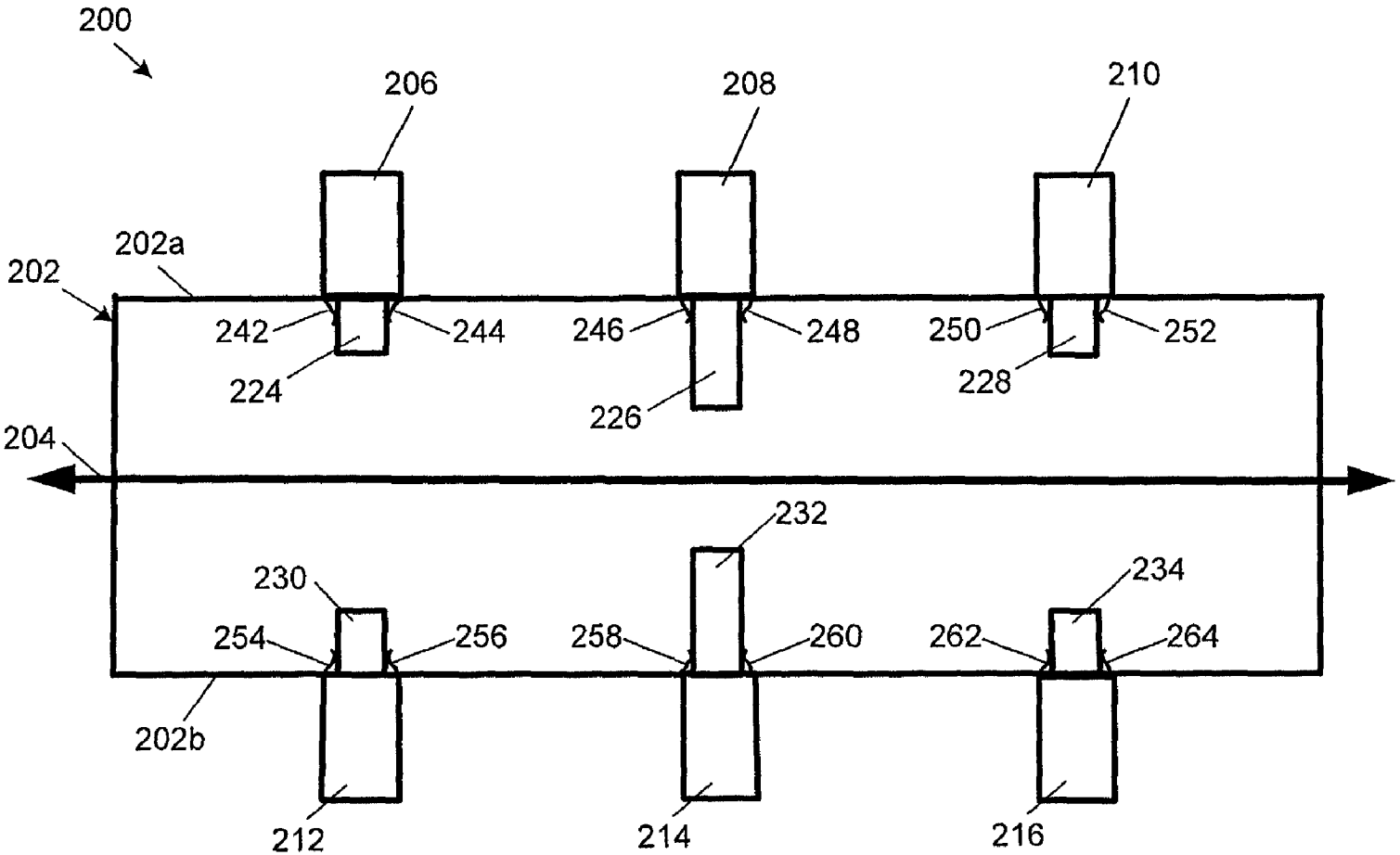
FIG. 2 is a cross-sectional view along line A–A' of the first exemplary embodiment of FIG. 1.

As shown in FIG. 2, which is a cross-sectional view 200 along line A–A' of the exemplary embodiment 100 in FIG. 1, side surfaces of the upper shutters 224, 226, 228 can be electrically connected (directly or indirectly) to the top surface 202*a* of the waveguide 202 with conductive means, such as spring fingers 242, 244, 246, 248, 250, 252, or any other suitable conductor or semiconductor, Side surfaces of the lower shutters 230, 232, 234 are electrically connected (directly or indirectly) to the bottom surface 202*b* of the waveguide 202*a* 202 with a set of spring fingers 254, 255, 256, 258, 260, 264, In the alternative, or in addition, electrical connection can be made with, for example, conductive brush like structures, Flexible conductive films can also be attached at points along the sides of the shutters with enough slack in the film to allow the shutters to move up and down.

Figure 3:
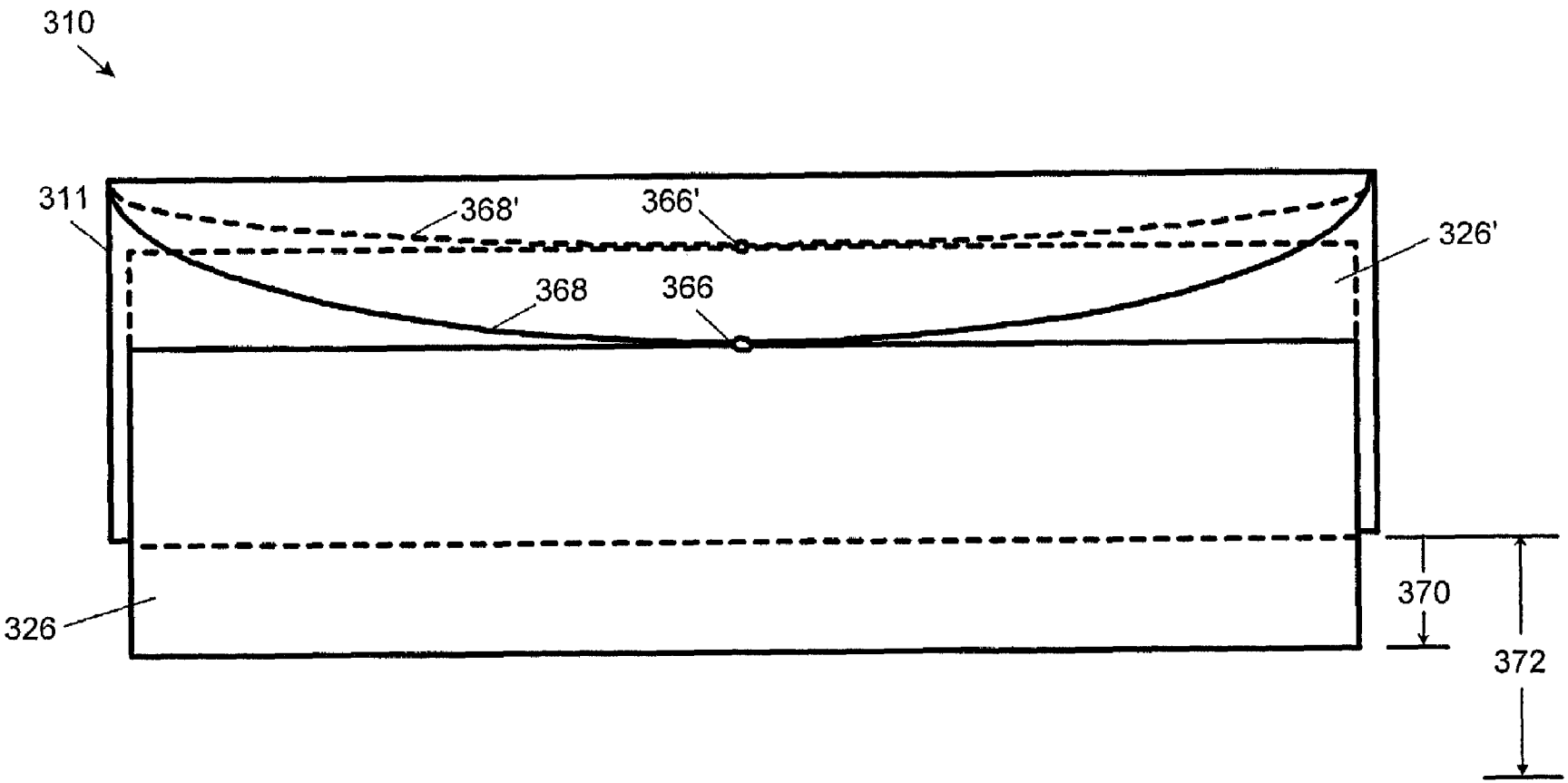
FIG. 3 is a cross-sectional view along line B–B' of an exemplary means in the first exemplary embodiment of FIG. 1.

As shown in FIG. 3, which is a cross-sectional view along line B–B' of an exemplary means 110 in FIG. 1, the electromechanical means is a piezoelectric device 310 having a shutter 326 that is connected to the central point 366 of a piezoelectric element 368. The ends of the piezoelectric element 368 are attached to the housing 311 of the piezoelectric device 310. The representation of the shutter 326, the central point 366 and the piezoelectric element 368 in solid lines of FIG. 3 is an illustration of an actuated state of the device (e.g., a voltage is being applied across the piezoelectric element 368 by wires at the ends of the piezoelectric element 324). The representation of the shutter 326', the central point 366' and the piezoelectric element 368' in dashed lines is an illustration of an unactuated state of the device (e.g., no voltage is being applied across the piezoelectric element 368'). The magnitude of the voltage applied to the piezoelectric element can be used to determine the amount of movement or actuation that the shutter 326 will undergo, and the final position 370 that the shutter will hold. The shutter 326 can move to, and hold, any position within a range of positions 372 depending upon the voltage applied across the piezoelectric element 368.

Figure 4:
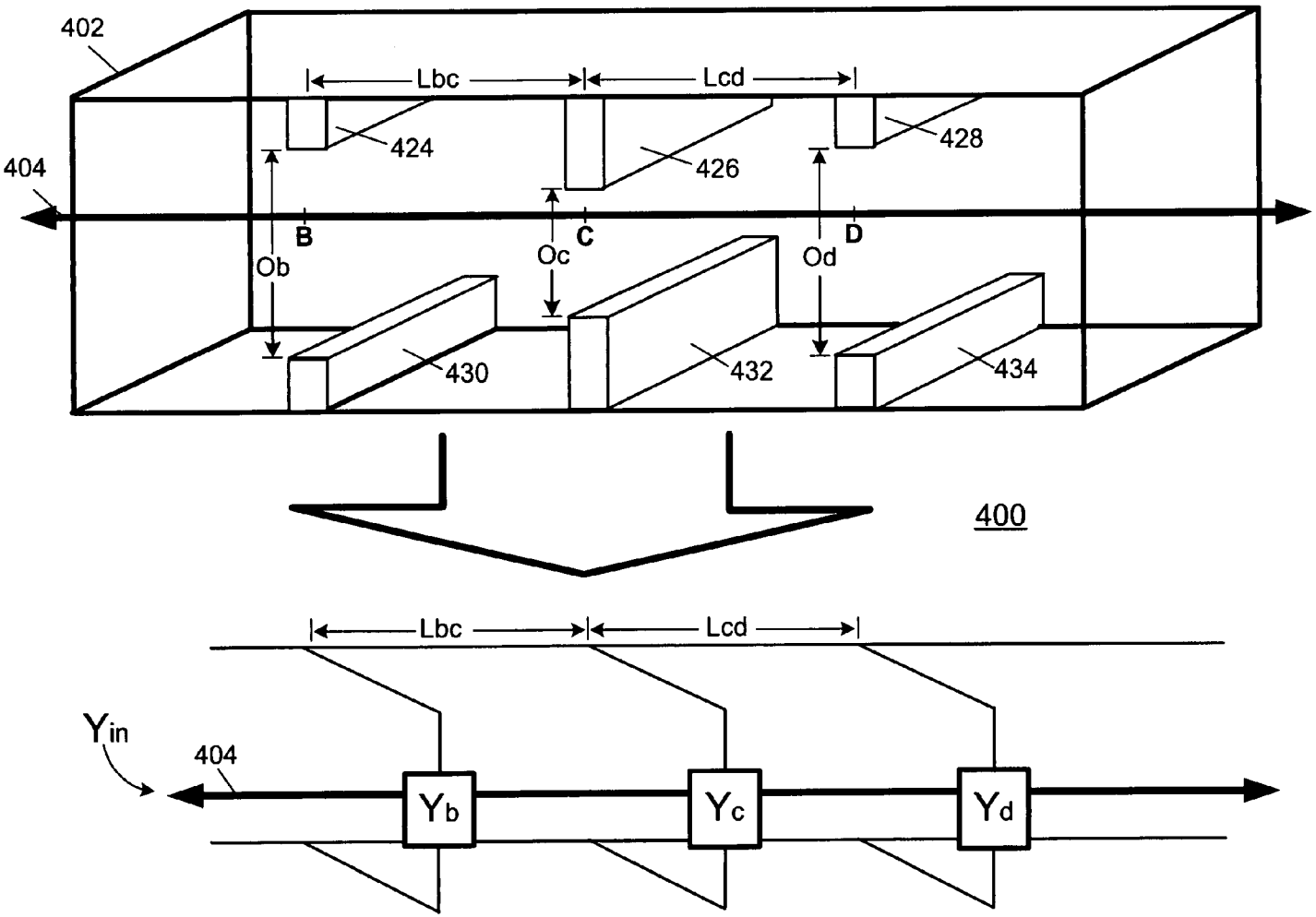
FIG. 4 is a perspective representation of a change of the physical dimensions of a waveguide path according to an exemplary embodiment of the present invention, and an electrical model thereof.

FIG. 4 is an exemplary representation 400 of a change of the physical dimensions of the waveguide 402 along the waveguide path 404 resulting from an implementation of the embodiment shown in FIG. 1 and a transmission line model of the implementation. A first voltage is applied to the first electromechanical means 124, the third electromechanical means 128, the fourth electromechanical means 130, and the sixth electromechanical means 134 of FIG. 1 that actuates the respective shutters of these means to a first position. The actuated positions for the shutters of the first, third, fourth, and sixth electromechanical means are respectively shown in FIG. 4 as a first shutter structure 424, a third shutter structure 428, a fourth shutter structure 430, and a sixth shutter structure 434. A second voltage is applied to the second electromechanical means 126 and fifth electromechanical means 132 of FIG. 1 that actuates the respective shutters of theses means to a second position different than the first position of the shutters in the first, third, fourth, and sixth electromechanical means. The actuated positions for the shutters of the second and fifth electromechanical means are respectively shown as a second shutter structure 426 and a fifth shutter structure 432 in FIG. 4.

The actuation of the shutters 424, 426, 428, 430, 432, 434 into the waveguide 402 changes the physical dimensions of the waveguide path 404, as shown in F*ig*. 4. For example, the cross-sectional area of the waveguide path 404 at a point B in the opening Ob between the first shutter structure 424 and fourth shutter structure 430 has been reduced. Further along the waveguide path 404 at a point C in the opening Oc between the second shutter structure 426 and the fifth shutter structure 432 the cross-sectional area is further reduced. At point D along the waveguide path 404, the cross-sectional area in the opening Od between the third shutter structure 428 and fourth shutter structure 434 is the same as the cross-sectional area between the first shutter structure 424 and fourth shutter structure 430.

The multiple-stub technique (i.e.. multiple sets of shutters) works for any number of stubs (i.e., sets of shutters). A single stub can provide phase shift, but reflect some the wave. Using two or more stubs, through proper choice of stub lengths (i.e., actuation of sets of shutters) and separations (i.e., distance between sets of shutters), reflections from each of the stubs can cancel so that a reduced overall reflection is seen at both ports of the waveguide 402.

As shown in FIG. 4, the admittance Yin along the waveguide path 404 can be modeled to use impedance matching techniques of transmission line theory. Each opening Ob, Oc, and Od represents a stub in the transmission line equivalent model. The admittance Yin includes components Yb, Yc, Yd, each of which represents the admittance of a respective stub (i.e., set of shutters) and is a function of the cross-sectional area of an opening,. Separations (i.e., Lbc and Lcd) between openings (i.e., Ob, Oc, and Od) affect how the reflections from admittances Yb, Yc and Yd combine to yield the overall reflection seen at both ports of the waveguide 402. Since the separations are fixed, the combination of openings is chosen via actuation of shutters so that the desired amount of phase shift and impedance match is achieved. For example, in FIG. 4, the combined reflection from the two outboard stubs nominally cancels the reflection from the center stub. Symmetry of the stub arrangement reduces losses due to reflection but is not necessary.

Figure 5:
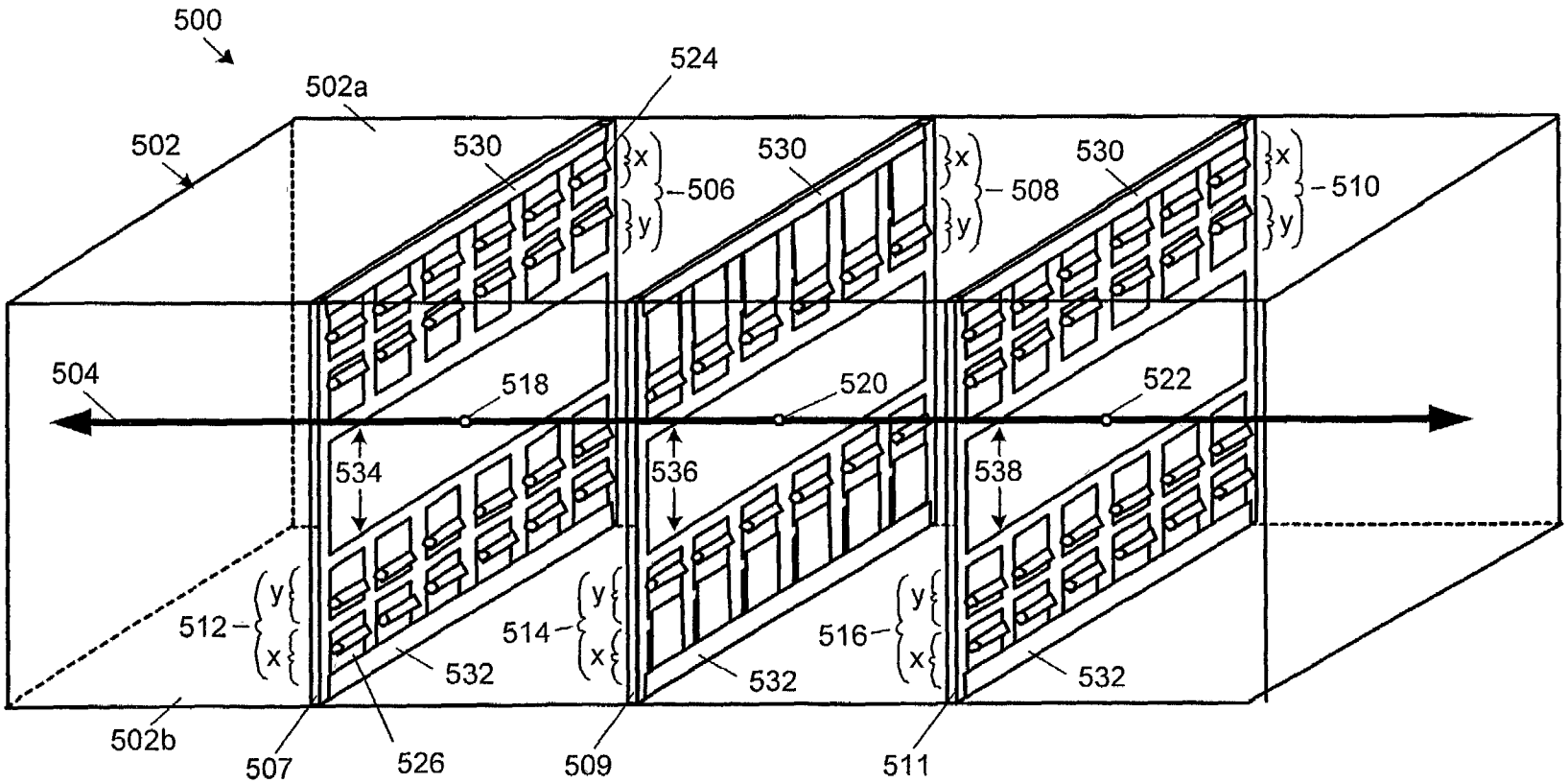
FIG. 5 is a perspective view of an exemplary embodiment using micro-mechanical devices.

FIG. 5 illustrates an exemplary embodiment 500 of a dynamic inline phase shifter having a waveguide 502 through which a signal travels in one of two directions (e.g. bi-directional) along the waveguide path 504. The waveguide 502 has a first (e.g., top) surface 502*a* and a second (e.g., bottom) surface 502*b* that are parallel to each other. Positioned within the waveguide 502 adjacent to and along the top surface are a first electromechanical means 506, a second electromechanical means 508, and a third electromechanical means 510. Positioned within the waveguide 502 adjacent to and along the bottom surface 502*b* are a fourth electromechanical means 512, a fifth electromechanical means 514, and a sixth electromechanical means 516. The first electromechanical means 506, second electromechanical means 508 and third electromechanical means 510 are a plurality of electromechanical means positioned serially along the waveguide path 504 sufficiently adjacent to the waveguide path 504 to change a physical dimension of the waveguide path upon actuation of at least one of the electromechanical means. In addition, the fourth electromechanical means 512, fifth electromechanical means 514, and sixth electromechanical means 516 are another plurality of electromechanical means positioned serially along the waveguide path 504 sufficiently adjacent to the waveguide path 504 to change a physical dimension of the waveguide path upon actuation of at least one of the electromechanical means. Each of the electromechanical means 506, 508, 510, 512, 514, 516 is an array of piezoelectric devices, an array of micro-electromechanical devices, or an array of other types of electromechanical devices suitable for changing a physical dimension of the waveguide path.

As shown in FIG. 5, each of the arrays 506, 508, 510, 512, 514, 516 has first and second rows of micro-electromechanical devices, respectively shown as x and y in FIG. 5. Each of the micro-electromechanical devices in rows x and y of arrays 506, 508, 510 has a shutter 524. Each of the micro-electromechanical devices in rows x and y of arrays 512, 514, 516 has a shutter 526. The shutters 524 of arrays 506, 508, 510 can move or unroll toward the bottom surface 502*b* and the shutters 526 of arrays 512, 514, 516 can move or unroll toward the top surface 502*a*, Each of the micro-electromechanical devices in row x of arrays 506, 508, 510 is connected (directly or indirectly) to the top surface 502*a* of the waveguide with a conductive strip 530. Each of the micro-electromechanical devices in row x of arrays 512, 514, 516 is connected (directly or indirectly) to the bottom surface 502*b* of the waveguide with a conductive strip 532.

As illustrated in FIG. 5, the dielectric substrate 507 containing the first array of micro-electromechanical devices 506 and the fourth array of micro-electromechanical devices 512 is normal to the waveguide path 504 at point 518. Other sets of arrays 508/514 on a dielectric substrate 509, and arrays 510/516 on a dielectric substrate 511 are normal to the waveguide path 504 at points 520 and 522, respectively. Between each of the arrays in a set of arrays there is an opening (e.g., 534, 536, 538) normal to the waveguide path 504 between the arrays (e.g., 506/512, 508/514, 510/516). The width of the opening between arrays of a set can be the same for all sets of arrays or can be different sizes.

Figure 6:
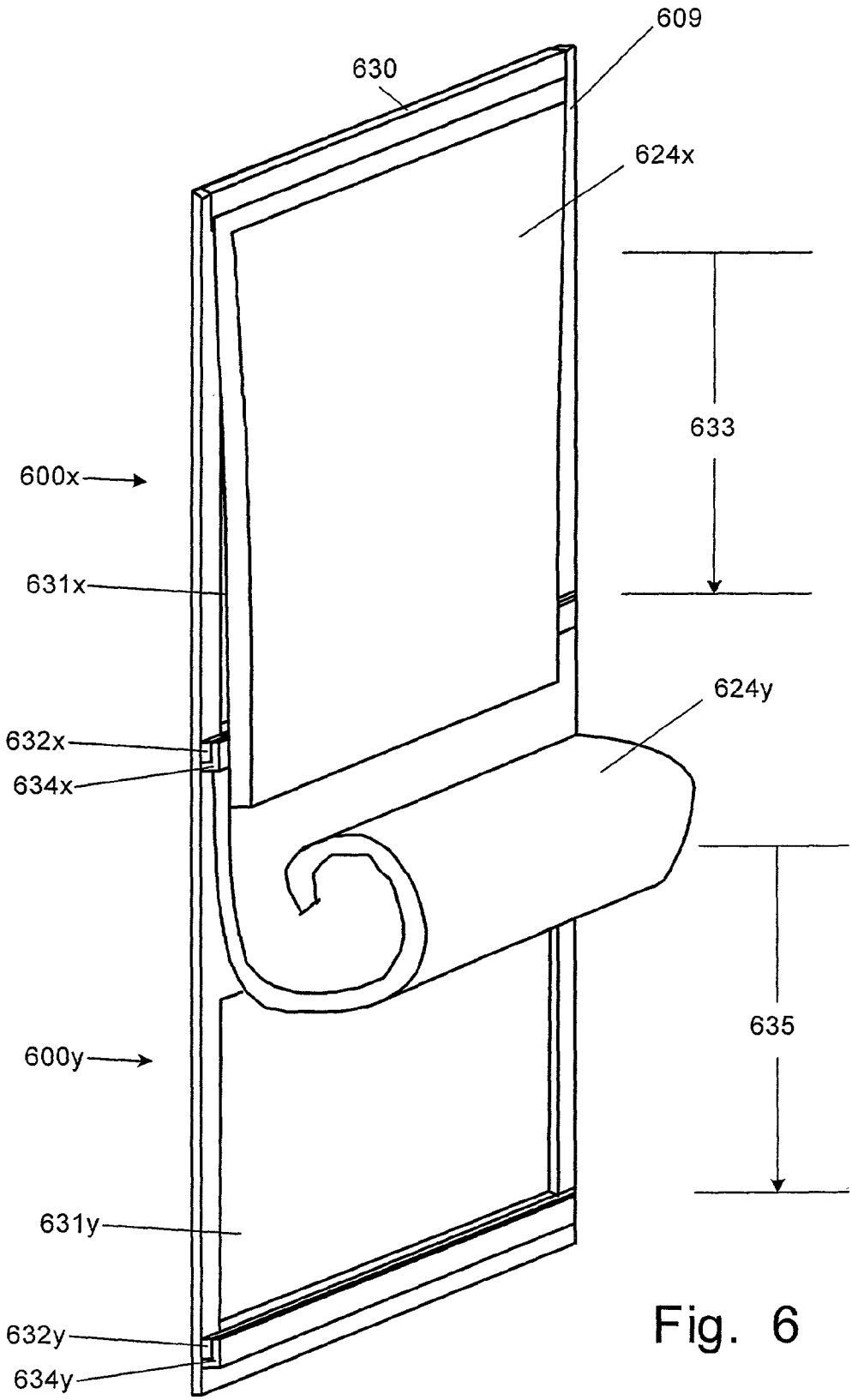
FIG. 6 is a perspective view of a first row and a second row of exemplary electromechanical means of FIG. 5.

FIG. 6 is a perspective view of a first row exemplary micro-electromechanical device 600*x* and a second row exemplary micro-electromechanical device 600*y* on a dielectric substrate 609 from the exemplary embodiment shown in FIG. 5. The micro-electromechanical devices 600*x* and 600*y* respectively include a shutter 624*x* and 624*y* mounted on the substrate 609. The shutter 624*x* is connected to the top or bottom surface of a waveguide (depending if it is in a top or bottom array) by the conductive film 630. The shutters 624*x* and 624*y* are respectively mounted above irises 631*x* and 631*y* in the substrate 609. Sill electrodes 632*x* and 632*y* are respectively mounted below the irises 631*x* and 631*y* in the substrate 609. A voltage applied between a sill electrode 632*x*, 632*y* and the a respective shutter 624*x*, 624*y* of a respective device by wires provides an electrostatic force between the shutter and the sill electrode. The electrostatic force pulls the a shutter 624*x*, 624*y* down over an iris 631*x*, 631*y* toward a sill electrode 632*x*, 632*y* of the respective device.

The representation of the shutter 624*x* in FIG. 6 is an illustration of actuated state of the micro-electromechanical device 600*x* (e.g., a voltage is applied between the shutter 624*x* and the sill electrode 632*x*). The amount of voltage applied determines the amount of unrolling or actuation that the shutter 624*x* will undergo and the final position that the shutter will hold, The shutter 624*x* can unroll to and hold a position within a range of positions 633 depending upon the voltage applied between the shutter element 624*x* and the sill electrode 632*x*.

The second row exemplary electromechanical device 600*y*, as shown in FIG. 6, is not actuated until the shutter 624*x* of the first row exemplary micro-electromechanical device 600*x* overlaps or contacts the shutter 624*y* of the second row exemplary micro-electromechanical device 600*y* . In general, a subsequent row of an array is not actuated until the row above has been fully actuated if the array is near the top surface or until the row below has been fully actuated if the array is near the bottom surface. A sill insulator can be used to prevent shorts between the sill and the shutter when a shutter is fully actuated. For example, as shown in FIG. 6, the shutter 624*x* of the first row exemplary micro-electromechanical device 600*x* is insulated from the sill electrode 632*x* by a sill insulator 634*x* when 624*x* of the first row exemplary micro-electromechanical device 600*x* overlaps or comes into contact with the shutter 624*y* of the second row exemplary micro-electromechanical device 600*y*. Subsequently, the shutter 624*y* of the second row exemplary micro-electromechanical device 600*y* can unroll to and hold a position within a range of positions 635 depending upon the voltage applied between the shutter element 624*y* and the sill electrode 632*y*. The second row exemplary micro-electromechanical device 600*y* also may include a sill insulator 634*y* between the sill electrode 632*y* and the shutter 624*y*.

The description of the micro-electromechanical devices 600*x* and 600*y* in FIG. 6 is for electro-mechanical devices in arrays adjacent to the top surface, such as 506, 508, 510 shown in FIG. 5. Micro-electromechanical devices for the arrays adjacent to the bottom surface, such as 512, 514, 516 shown in FIG. 5, can have the shutter mounted on the substrate below the iris in the substrate and the sill electrode mounted above the iris in the substrate. Each row of micro-mechanical devices within each array can have a sill electrode for all of the micro-mechanical devices in a row. Furthermore, the portion of a row x micro-electromechanical device having the coiled portion of shutter can protrude from a surface of the waveguide.

The embodiment in FIG. 5 can also be represented and modeled as shown in FIG. 3. For example, a first voltage applied to row x of the first array 506, the third array 510, the fourth array 512 and the sixth array 516 that halfway closes the irises in row x of these respective arrays. The first voltage is also applied to row y of the second array 508 and the fifth array 514 so that the irises in row y of these respective arrays are halfway closed. A second voltage is applied to row x of the second array 508 and the fifth array 514 so that the irises in row x of these respective arrays are closed. The area of the actuated positions (i.e., area of closed or partially closed iris) for the shutters in the first array 506 can be summed together along with the susceptance of the substrate (which includes any unactuated devices) that the first array 506 is on and thus be collectively seen as the first shutter structure 424 in FIG. 4. Likewise, second array 508 can be seen as the second shutter structure 426, third array 510 can be seen as the third shutter structure 428, fourth array 512 can be seen as the fourth shutter structure 430, fifth array 514 can be seen as the fifth shutter structure 432, and sixth array 516 can be seen as the sixth shutter structure 434.

To achieve a result comparable to that of the FIG. 4 embodiment, the cross-sectional area of the waveguide path 404 at a point B in the opening Ob between the first shutter structure 424 and fourth shutter structure 430 of FIG. 4 can be substantially equal (i.e., to within ten percent, or more or less) to a summation of the open irises in the first array 506, the fourth array 512, and the opening 534 between the first and fourth arrays. The cross-sectional area of the waveguide path 404 at point C in the opening Oc between the second shutter structure 426 and the fifth shutter structure 432 of FIG. 4 is less than the cross-sectional area of the waveguide path at point B in the opening Ob, and can be substantially equal to a summation of the open irises in the second array 508, the fifth array 514, and the opening 536 between the first and fourth arrays. The cross-sectional area of the waveguide path 404 at point D in the opening Od between the third shutter structure 428 and sixth shutter structure 434 can be substantially equal to a summation of the open irises in the third array 510, the sixth array 516, and the opening 538 between the first and fourth arrays. Alternatively, those skilled in the art will appreciate that each set of arrays can have a unique opening size to tune the sets of arrays for impedance matching purposes. Furthermore, some or all of the arrays can have more or less than two rows of micro-electromechanical devices.

The exemplary embodiments utilize irises or shutters arranged to change physical dimensions of the waveguide path. The irises or shutters, when extending from either the top or bottom of the waveguide, introduce capacitive susceptances. In addition, the irises or shutters when extending from either side of the waveguide, introduce inductive susceptances. Combinations of arrangements can be configured to introduce both inductive and capacitive susceptances.

Figure 7:
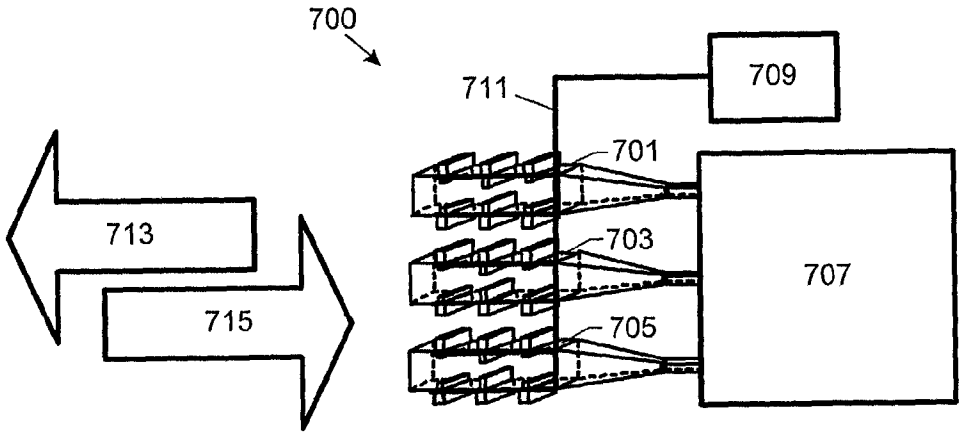
FIG. 7 is an exemplary radar system configured in accordance with the present invention.

FIG. 7 illustrates an exemplary radar system 700 having a plurality of dynamic inline phase shifters 701, 703, 705 connected to a radar transceiver 707. An actuator control circuit 709 is connected to the dynamic inline phase shifters 701, 703, 705 by wiring 711. The actuator control circuit controls the actuation of the electromechanical means in each of the dynamic inline phase shifters 701, 703, 705 and the phase shift of a signal traveling through a dynamic inline phase shifter. Each in line phase shifter can phase shift one of a transmitted 713 and received 715 radar signals. In addition, other types of signals, such as radio signals, can be phase shifted.

Figure 8:
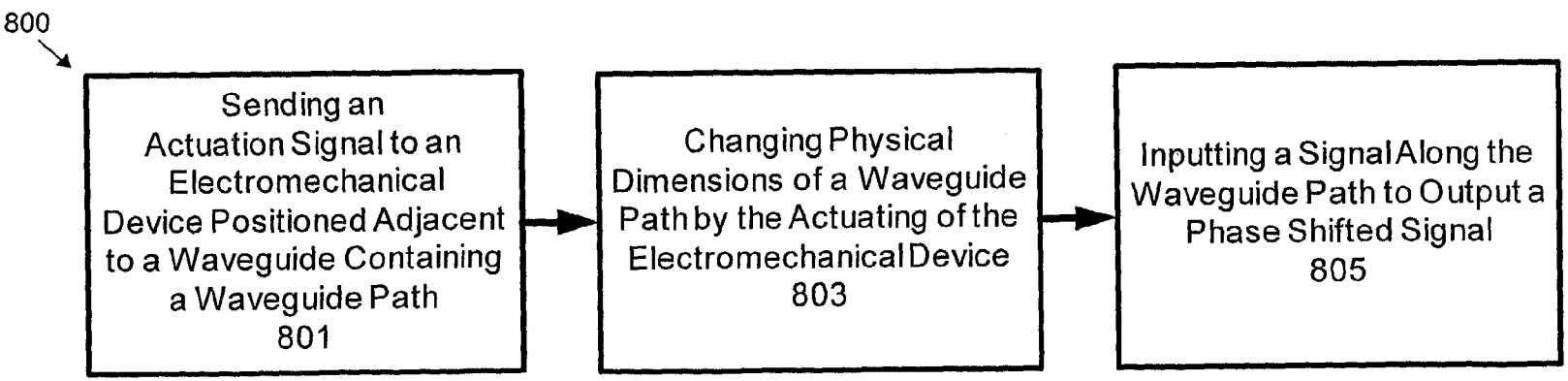
FIG. 8 is an exemplary method of the present invention.

FIG. 8 illustrates an exemplary embodiment of method 800 for dynamically phase shifting a signal, As shown in FIG. 8, an actuation signal is sent to the electro-mechanical device positioned adjacent to a waveguide containing the waveguide path 801. The physical dimensions of the waveguide path are changed by the actuation of the electro-mechanical device 803. Then a signal is inputted along the waveguide path so that a phase shifted signal is outputted 805.

It will be apparent to those skilled in the art that various changes and modifications can be made in the inline phase shifter of the present invention without departing from the spirit and scope thereof, Thus, it is intended that the present invention cover the modifications of this invention provided they come within the scope of the appended claims and their equivalents.

What is claimed is:

1. An inline phase shifter comprising:

a waveguide having at least first and second electrically conducting surfaces and a waveguide path; and at least first and second electromechanical means for changing a physical dimension of the waveguide path to phase shift a signal which travels along the waveguide path, wherein each of the at least first and second electromechanical means comprises either a piezoelectric element or an electrostatically actuated shutter, wherein the shutters are electrically connected to the respective electrically conducting surface for providing phase shift and impedance matching, and wherein the first electromechanical means has a first shutter that can move toward the second surface and the second electromechanical means has a second shutter that can move toward the first surface.

2. The inline phase shifter according to claim 1, wherein the at least first and second electromechanical means is a set of first and second electromechanical devices arranged at one or more points along the waveguide path.

3. The inline phase shifter according to claim 1, wherein said at least first and second electrically conducting surfaces comprises a first surface of the waveguide parallel to a second surface of the waveguide, and wherein each of the at least first and second electromechanical means includes a first electromechanical means positioned adjacent to the first surface, and a second electromechanical means positioned adjacent to the second surface.

4. The inline phase shifter of claim 1, wherein said physical dimension of the waveguide path is changed by actuating the at least first and second electro-mechanical means.

5. The inline phase shifter according to claim 1, wherein each of said at least first and second electromechanical means comprises a respective micro-electromechanical device.

6. A radar system having an inline phase shifter according to claim 1, wherein the inline phase shifter is connected to a radar transceiver for phase shifting one of transmitted and received signals.

7. An inline phase shifter comprising:

a waveguide having conducting surfaces along a waveguide path of the waveguide; and a plurality of electromechanical devices positioned serially along the waveguide path sufficiently adjacent to the waveguide path to change a physical dimension of the waveguide path upon actuation of at least one of the plurality of electromechanical devices, wherein each of the plurality of electromechanical devices comprises either a piezoelectric element or an electrostatically actuated shutter, wherein each of said plurality of electromechanical devices is positioned entirely within the waveguide.

8. A method for phase shifting a signal comprising:

changing physical dimensions of a waveguide path by actuating first and second electromechanical devices; and inputting a signal along the waveguide path to output a phase shifted signal, wherein each of the first and second electromechanical devices comprises either a piezoelectric element or an electrostatically actuated shutter, wherein the shutters are electrically connected to the respective conducting surface of a waveguide having first and second surfaces which define the waveguide path for providing phase shift and impedance matching, and wherein the first electromechanical device has a first shutter that can move toward the second surface and the second electromechanical device has a second shutter that can move toward the first surface.

9. The method for phase shifting a signal according to claim 8, comprising:

sending an actuation signal to at least one of the electromechanical devices positioned adjacent to the waveguide containing the waveguide path.

10. An inline phase shifter comprising:

a waveguide having at least one electrically conducting surface and a waveguide path; and at least one electromechanical means for changing a physical dimension of the waveguide path to phase shift a signal which travels along the waveguide path, wherein the at least one electromechanical means comprises either a piezoelectric element with a moveable shutter or an electrostatically actuated shutter, wherein said at least one electromechanical means is positioned entirely within the waveguide.

11. An inline phase shifter, comprising:

a waveguide having a waveguide path; and a plurality of electromechanical devices positioned serially along the waveguide path sufficiently adjacent to the waveguide path to change a physical dimension of the waveguide path upon actuation of at least one of the plurality of electromechanical devices, wherein the plurality of electro-mechanical devices is positioned entirely within the waveguide.

12. An inline phase shifter comprising:

a waveguide having a waveguide path; and at least one micro-electromechanical device positioned sufficiently adjacent to the waveguide path for physical actuation of the at least one micro-electromechanical device in the waveguide path, wherein the at least one micro-electromechanical device comprises either a piezoelectric element with a moveable shutter or an electrostatically actuated shutter, and wherein the shutter is electrically connected to the waveguide for providing phase shift and impedance matching, wherein said at least one micro-electromechanical device is positioned entirely within the waveguide.

13. The inline phase shifter according to claim 12, wherein said waveguide comprises a first surface and a second surface parallel to the waveguide path and includes a first one of said at least one micro-electromechanical device positioned adjacent to the first surface and a second one of said at least one micro-electromechanical device positioned adjacent to the second surface.

14. The inline phase shifter according to claim 13, wherein the first and second micro-electromechanical devices are a set of devices arranged at one or more points along the waveguide path.

15. The inline phase shifter according to claim 13, wherein the first and second micro-electromechanical devices are positioned within the waveguide.

16. An inline phase shifter comprising:

a waveguide having a waveguide path; and at least one micro-electromechanical device positioned sufficiently adjacent to the waveguide path to change a physical dimension of the waveguide path upon actuation of the at least one micro-electromechanical device, wherein the at least one micro-electromechanical device comprises either a piezoelectric element with a moveable shutter or an electrostatically actuated shutter, wherein said waveguide comprises a first surface and a second surface parallel to the waveguide path and includes a first one of said at least one micro-electromechanical device positioned adjacent to the first surface and a second one of said at least one micro-electromechanical device positioned adjacent to the second surface, and wherein the first micro-electromechanical device has a first shutter that can unroll toward the second surface and the second micro-electromechanical device has a second shutter that can unroll toward the first surface.

17. The inline phase shifter according to claim 16, wherein there is an opening normal to the waveguide path between the first and second shutters.

18. An inline phase shifter comprising:

a waveguide having a waveguide path; and at least one micro-electromechanical device positioned sufficiently adjacent to the waveguide path to change a physical dimension of the waveguide path upon actuation of the at least one micro-electromechanical device, wherein the at least one micro-electromechanical device comprises either a piezoelectric element with a moveable shutter or an electrostatically actuated shutter, and wherein said waveguide comprises:

a first surface and a second surface parallel to the waveguide path;

a first array of said at least one micro-electromechanical devices positioned adjacent to the first surface; and a second array of said at least one micro-electromechanical devices positioned adjacent to the second surface, wherein devices of the first array have a respective shutter that can move toward the second surface, and devices of the second array have a respective shutter that can move toward the first surface.

19. The inline phase shifter according to claim 18, wherein there is an opening normal to the waveguide path between the first and second arrays of micro-electromechanical devices.

20. The inline phase shifter according to claim 19, wherein the first and second arrays are a respective set of said at least one micro-electromechanical devices arranged at one or more points along the waveguide path.

21. An inline phase shifter comprising:

a waveguide having at least first and second conducting surfaces along a waveguide path of the waveguide; and a plurality of electromechanical devices positioned serially along the waveguide path sufficiently adjacent to the waveguide path to change a physical dimension of the waveguide path upon actuation of at least one of the plurality of electromechanical devices, wherein each of the plurality of electromechanical devices comprises either a piezoelectric element or an electrostatically actuated shutter, wherein the electromechanical devices are electrically connected to the respective conducting surface of the waveguide for providing phase shift and impedance matching, and wherein at least one of the plurality of electromechanical devices has a first shutter that can move toward the second surface and at least another of the plurality of electromechanical devices has a second shutter that can move toward the first surface.

22. The inline phase shifter according to claim 21, wherein a physical dimension of the waveguide path is changed by actuating at least one of the plurality of electromechanical devices.

23. The inline phase shifter according to claim 21, wherein each of said plurality of electromechanical devices comprises a respective micro-electromechanical device.

24. An inline phase shifter comprising:

a waveguide having at least first and second electrically conducting surfaces and a waveguide path, the first surface of the waveguide being parallel to the second surface of the waveguide; and at least one electromechanical means for changing a physical dimension of the waveguide path to phase shift a signal which travels along the waveguide path, wherein the at least one electromechanical means comprises either a piezoelectric element with a moveable shutter or an electrostatically actuated shutter, wherein the at least one electromechanical means includes a first electromechanical means positioned adjacent to the first surface, and a second electromechanical means positioned adjacent to the second surface, and wherein the first electro-mechanical means has a first shutter that can move toward the second surface and the second electro-mechanical means has a second shutter that can move toward the first surface.

25. The inline phase shifter according to claim 24, wherein there is an opening normal to the waveguide path between the first and second electromechanical means.

26. The inline phase shifter according to claim 25, wherein the first and second electromechanical means are positioned within the waveguide.

* * * * *